US005720563A

United States Patent [19]

Nakagawa

[11] Patent Number: 5,720,563

[45] Date of Patent: Feb. 24, 1998

[54] COSMETIC APPLICATOR

[75] Inventor: Tatsuhiro Nakagawa, Saitama-ken, Japan

[73] Assignee: OHTO Kabushiki Kaisha, Tokyo, Japan

[21] Appl. No.: 621,312

[22] Filed: Mar. 25, 1996

[30] Foreign Application Priority Data

Apr. 5, 1995 [JP] Japan ..... 7-078599

[51] Int. Cl.[6] ..... A46B 11/00; A45D 34/00

[52] U.S. Cl. ..... 401/119; 401/15; 401/122; 401/126; 401/129

[58] Field of Search ..... 401/122, 129, 401/126, 15, 119

[56] References Cited

U.S. PATENT DOCUMENTS

| | | | |
|---|---|---|---|
| 252,603 | 1/1882 | Kennish | 401/122 X |
| 424,539 | 4/1890 | Cole | 401/122 |
| 1,254,714 | 1/1918 | McCombs | 401/129 |
| 1,660,969 | 2/1928 | Langston | 401/15 |
| 2,253,779 | 8/1941 | Gutierrez | 401/15 |
| 2,691,184 | 10/1954 | Miller et al. | 401/129 |
| 2,917,766 | 12/1959 | Ciffo | 401/129 X |
| 3,469,928 | 9/1969 | Widegren | 401/122 |
| 4,841,996 | 6/1989 | Gueret | 401/129 X |
| 5,097,853 | 3/1992 | Nehashi . | |

FOREIGN PATENT DOCUMENTS

| | | |
|---|---|---|
| 2-111303 | 4/1990 | Japan . |
| 2-126512 | 10/1990 | Japan . |
| 4-7009 | 1/1992 | Japan . |

*Primary Examiner*—Steven A. Bratlie
*Attorney, Agent, or Firm*—Wenderoth, Lind & Ponack

[57] ABSTRACT

A cosmetic applicator includes a valve disc having a central hole and fixed to an inner portion of a container in which a liquid to be applied is stored. A shaft is engageable with and disengageable from the container and includes a front portion having a brush holder with a brush projecting therefrom. An annular projection at a portion of the shaft in the vicinity of a base portion of the brush holder defines an annular recess inside of the annular projection. An outer surface of the brush holder has at least one longitudinally extending groove communicating with the annular recess. A front end portion of the annular projection and a rear end portion of the valve disc are engageable in a liquid tight manner.

9 Claims, 2 Drawing Sheets

COSMETIC APPLICATOR

BACKGROUND OF THE INVENTION

This invention relates to an applicator for liquid cosmetics, such as eyeliner, eye shadow and rouge, and more particularly to a so-called "dipping pen" type applicator used by bringing a brush (applicator tip) into contact with a fluid cosmetic and saturating the former with the latter.

Various kinds of dipping pen type applicators have heretofore been proposed, including applicators disclosed in Japanese Patent Laid-Open No. 111303/1990 and Japanese Utility Model Laid-Open Nos. 126512/1990 and 7009/1992. Of these applicators, an eyeliner structure disclosed in Japanese Patent Laid-Open No. 111303/1990 is formed by providing an eyeliner liquid-impregnated fibrous reservoir, and bringing a pen point-like member into direct contact with the fibrous reservoir. The applicator disclosed in Japanese Utility Model Laid-Open No. 26512/1990 is formed by providing a plug member (orifice) between a raw cosmetic liquid in a cap and a pen-like member. Japanese Utility Model Laid-Open No. 7009/1992 discloses a structure formed by providing a fibrous reservoir at one end of an ink tank in a cap, and a packing at the back of the fibrous reservoir, whereby the sealability of the applicator is improved.

However, these types of applicators are used by saturating a front end only of a brush with a liquid to be applied. Thus, the amount of liquid which can be held inside the brush is limited. Consequently, a discharge rate of the liquid becomes undesirably low such that the liquid cannot be applied as intended. In some cases, the liquid to be applied overflows the brush and soils a shaft of the applicator.

Therefore, an object of the present invention is to eliminate the above drawbacks encountered in the conventional techniques and to provide a simply constructed and very economical cosmetic applicator capable of satisfactorily dealing with an overflow of liquid cosmetic from a brush.

SUMMARY OF THE INVENTION

The present invention is directed to a cosmetic applicator characterized in that a valve disc having a central hole is fixed to an inner portion of a container in which a liquid to be applied is stored. A shaft is engageable with and disengageable from the container provided. A brush holder with a brush supported at a front end portion thereof is provided on the shaft so that the brush holder projects therefrom. An annular projection is provided at a portion of the shaft which is in the vicinity of a base portion of the brush holder, to define an annular recess inside of the annular projection. An outer surface of the brush holder is provided with at least one longitudinally extending groove communicating with the annular recess. A front end portion of the annular projection and a rear end portion of the valve disc are engageable in a liquid tight manner.

It is possible to prevent stagnation of liquid in a base portion of the brush by providing one or a plurality of through holes in a part of the brush holder which is in the vicinity of a base portion thereof, thus enabling the base portion of the brush to communicate with the groove.

The brush holder has an outer shape that diverges toward the annular projection, and the depth of the groove may increase gradually toward the annular projection.

It is desirable that the valve disc comprises an elastic body, and that a front end portion of the annular projection be tapered and engage annularly with the rear end portion of the valve disc in a liquid tight manner.

If a rearwardly divergent cylindrical body is positioned over the outer surface of the brush holder, the cylindrical body can serve as a cover for preventing liquid in the groove from being exposed and for protecting the brush holder.

The groove formed in the brush holder of the shaft communicates at its front end with an outer surface of an intermediate portion of the brush, and at its rear end with the annular recess formed on the inner side of the annular projection. Therefore, when such an amount of liquid to be applied that exceeds the liquid holding capacity of the brush flows into the brush, the excess liquid to be applied escapes from the brush and flows into the groove formed so as to extend in the longitudinal direction of the brush holder, the resultant liquid gathering in the annular recess. Accordingly, the groove and annular recess serve as spare tanks or reservoirs for excess liquid. Since the liquid to be applied overflowing the brush can thus be held in the annular recess, which is formed on the inner side of the annular projection, via the groove provided in the brush holder, the outer surface of the shaft is not soiled by the liquid to be applied. Moreover, since the rear end portion of the valve disc and the front end portion of the annular projection of the shaft are engaged with each other in a liquid tight manner, the liquid to be applied that reaches the annular recess does not flow to the outside of the shaft, so that soiling of the outer surface of the shaft can be prevented more effectively.

PREFERRED EMBODIMENT OF THE INVENTION

Figure 1:
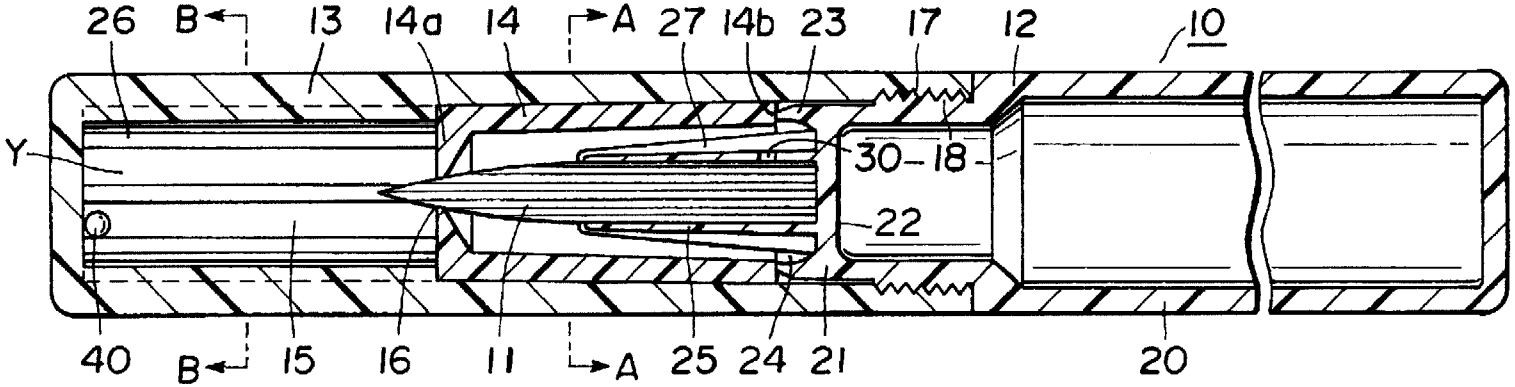
FIG. 1 is a longitudinal sectional view of an embodiment of a cosmetic applicator according to the present invention.

Referring to FIG. 1 showing a preferred embodiment of the present invention, an applicator body designated by reference numeral 10 includes a shaft or cap 12 having a brush 11 attached to a front end portion thereof, and a container 13 combined (screw-engaged in the illustrated embodiment) detachably with the shaft. The brush 11 can comprise a fibrous material, such as nylon, urethane or polyester, or foam, or a sintered body, or a bundle of hair. The shaft 12 and the container 13 in which a liquid to be applied (raw cosmetic liquid) is stored can comprise a molded material of a suitable resin, for example, an ABS resin, polyethylene and polypropylene. A valve disc member 14 formed of an elastic material, such as rubber or a desired soft synthetic resin, is set fixedly and unitarily within container 13 to define a liquid storage chamber 15 in which a liquid Y to be applied is stored.

The valve disc member 14 defining the liquid storage chamber 15 in the container 13 comprises a cross-sectionally U-shaped cylindrical body provided with a central hole 16 in a bottom portion or a wall **14*a* thereof. A front or leading end portion of the brush 11 projects through the central hole 16 in the wall 14***a* and contacts the liquid in the liquid chamber, the liquid being thus held by the brush 11. In order that the projecting and retracting of the front end portion of the brush 11 into and from the liquid chamber are done smoothly, the central hole 16 is formed so as to diverge toward a base portion of the brush. Although the central hole 16 may be formed conically, it can also be formed to a desired shape as necessary, such as a slit-like shape or a cross-sectionally triangular shape. Thereby, movement of air, which occurs when the brush is projected into and retracted from the liquid chamber, occurs smoothly and produces a sealing effect owing to cooperation with the effect of the cross-sectional shape of the deformable brush 11. Thus, the valve disc 14 fixed to container 13 defines therein liquid-tight chamber 15.

The liquid container 13 is provided in an inner surface of a rear end portion thereof with a thread 17 which is engaged removably with a threaded portion 18 of the shaft 12 which will be described later. The shaft 12 is provided with a hollow grip portion 20 positioned at a rear part thereof, the above-mentioned threaded portion 18 of a slightly smaller diameter at the front side of the grip portion 20, and an intermediate or front end portion 21, the diameter of which is smaller than that of the threaded portion 18, at the front side of the threaded portion 18. The intermediate portion 21 has a bottom wall 22, and a forwardly (i.e., in the direction of the brush 11) extending annular projection 23, on the inner side of which is formed an annular recess 24. A cylindrical brush holder 25 projects from the bottom wall 22 of the shaft, and covers and retains the portion of the brush 11 which is behind a substantially intermediate portion thereof. The annular projection 23 is tapered at its front end portion and engages annularly and linearly with the rear end portion 14*b* of the valve disc 14, whereby liquid tightness of the applicator is ensured.

Figure 2:
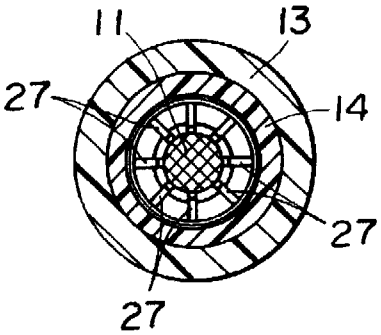
FIG. 2 is a sectional view taken along line A—A in FIG. 1.

As shown in FIGS. 1 and 2, the brush holder 25 of the shaft 12 is formed so as to have an outer appearance convergent in the direction of the front end of the brush, and has grooves 27 the depth of which increases gradually in the rearward direction. These grooves 27 communicate at their front ends with an outer surface of an intermediate portion of the brush, and at their rear ends with the annular recess 24 formed on the inner side of the annular projection 23. Namely, when a liquid to be applied, the amount of which exceeds the liquid retaining capacity of the brush 11, flows into the brush, the excess liquid flows into the grooves 27 which are formed to extend in the longitudinal direction of the brush holder 25, and then gathers in the annular recess 24. Accordingly, the grooves 27 and annular recess 24 serve as spare tanks or reservoirs for the liquid to be applied.

The use of such cosmetic applicator now will be described simply with reference to FIG. 1. FIG. 1 shows the applicator not in use. In order to use this applicator, the container 13 is turned with respect to the shaft 12 so as to disengage the threads 17, 18 from each other. Consequently, the brush contacting the liquid Y in the container 13 is drawn out from the central hole 16 of the valve disc 14 with the brush left saturated with the liquid, to be exposed to the outside of the container 13 and rendered ready to be used. When the brush has finished being used, the brush 11 is inserted into the central hole 16 of the valve disc, and the shaft 12 is engaged with the container 13 by turning the former with respect to the latter. The brush 11 in this condition keeps in contact with the liquid Y in the container 13.

Referring to FIG. 1, a reference numeral 30 denotes a through hole formed in a base portion of the brush holder 25, i.e. the portion thereof which is in the vicinity of the bottom wall 22, in such a manner that the through hole 30 communicates with the grooves 27. Owing to through hole 30, the liquid to be applied that gathers in the base portion of the brush 11 does not stay therein, but rather can flow or circulate from the interior of the brush 11 to the grooves 27 and annular recess 24. If the problem of the liquid staying in the brush does not arise, the through hole 30 can be omitted. Reference numeral 40 denotes a liquid agitating metal ball provided in the liquid chamber 15, which ball can also be omitted.

Figure 3:
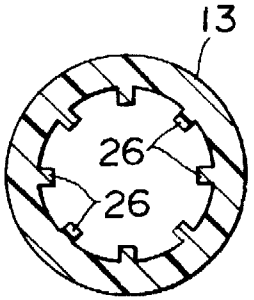
FIG. 3 is a sectional view taken along line B—B in FIG. 1.

In the embodiment of FIG. 1, the liquid container 13 is provided on the inner surface thereof with a plurality of ribs 26 as shown in FIG. 3 which extend longitudinally at regular intervals, and the valve disc 14 is provided in the outer surface thereof with longitudinally extending grooves that are complementary to the ribs 26, whereby the container 13 and valve disc 14 are slidably engaged. If the valve disc 14 can be engaged with a predetermined portion of the inner part of the container 13, it is not necessary to provide such ribs 26 and complementary grooves.

Figure 4:
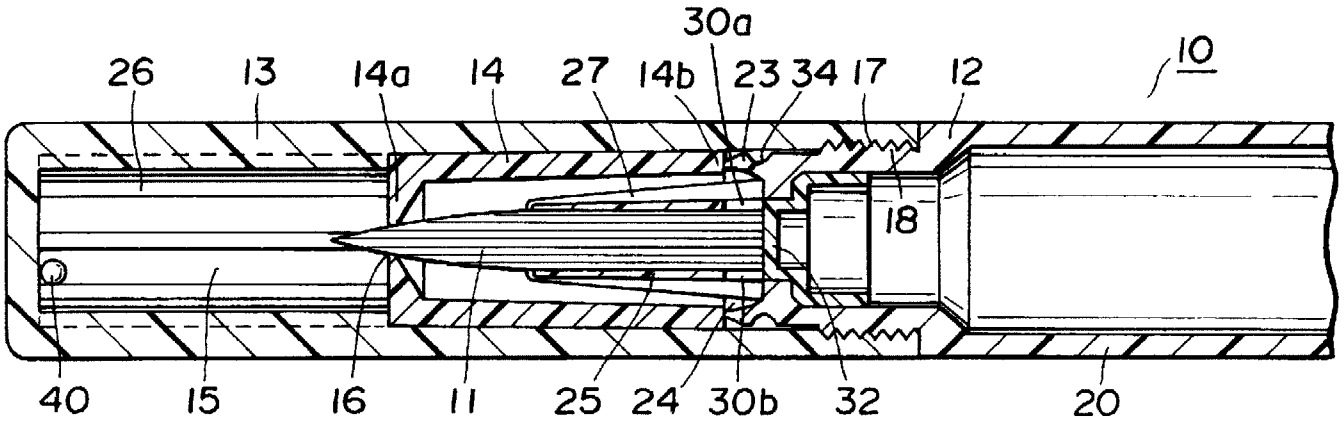
FIG. 4 is a longitudinal sectional view of a principal portion of another embodiment of the present invention.

FIG. 4 shows a modification of the embodiment of FIG. 1. In this modified example, brush holder 25 of shaft 12 is provided at a base portion thereof with a plurality (for example, eight) of through holes 30*a*, 30*b* (only two holes are shown) so that these holes communicate with the grooves 27 and annular recess 24. Since the through holes 30*a*, 30*b* are formed in the base portion of the brush holder, i.e. the portion thereof which is very close to bottom wall 22 shown in FIG. 1, such bottom wall becomes an obstacle to the manufacture of the applicator. Therefore, in this embodiment a bottom member 32 is formed separately as an additional part and then is fitted in the brush holder. Although the number of parts increases by one, the provision of this part is advantageous in that liquid tending to stay or accumulate in the base portion of the brush 11 is circulated easily. Reference numeral 34 denotes an annular groove or a plurality of regularly spaced bores provided in the outer circumferential surface of annular projection 23 of a shaft 12. It cannot be said that there is no possibility that the liquid to be applied will leak outwardly when a rear end portion 14*b* of a valve disc and a front end portion of the annular projection 23 are in imperfect linear contact with each other. Such annular groove 34 or such bores serve as positions where such a liquid gathers. However, when the linear contact of the mentioned parts is in a satisfactory condition, such a difficulty can be avoided, so that the groove (bores) 34 can be omitted since the grooves 27 and annular recess 24 can hold any excess liquid. Since the construction of the remaining portions of this modified example is identical with that described with reference to FIGS. 1–3, such mentioned portions are designated by the same reference numerals shown in FIG. 1, and detailed description thereof is omitted.

Figure 6:
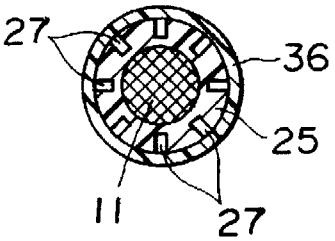
FIG. 6 is a sectional view taken along line C—C in FIG. 5.
Figure 5:
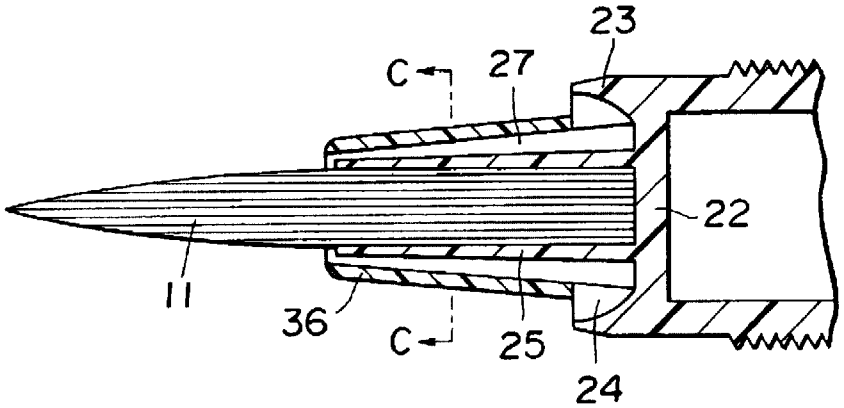
FIG. 5 is a longitudinal sectional view of a principal portion of still another embodiment of the present invention.

FIGS. 5 and 6 show another embodiment of the present invention, in which a rearwardly divergent cylindrical member 36 is positioned over the grooves 27 formed in brush holder 25, so as to prevent a cosmetic liquid from being exposed to the outside and to protect brush holder 25. Since the outer side of the grooves 27 is covered with cylindrical member 36, soil on the inner surface of the grooves due to the cosmetic liquid does not become prominent. The construction of the remaining portions of this embodiment is identical with that of the corresponding portions of the embodiment of FIG. 1 and description thereof is omitted.

Since the cosmetic applicator according to the present invention is constructed as mentioned above, the liquid to be applied that overflows the brush 11 can be held in the annular recess 24 formed on the inner side of the annular projection 23, through the grooves 27 provided in the brush holder 25. Accordingly, the outer surface of the shaft 12 is not soiled by the liquid. Moreover, the rear end portion **14*b* of the valve disc 14 and the front end portion of the annular projection 23 are engaged with each other annularly in a liquid tight manner so that the liquid flowing into the annular recess 24 does not reach the outside of the shaft 12**. Therefore, soiling of the shaft can be prevented more effectively.

What is claimed is:

1. A cosmetic applicator comprising:

a container having opposite closed and open ends;

a valve disc member fixed within said container, said valve disc member having at an inner end thereof a wall extending across the interior of said container and defining therein a storage chamber to receive therein a cosmetic liquid, said wall having therethrough a central hole, and said valve disc member having an annular outer end;

a shaft member having a front end portion and a brush holder projecting forwardly from said front end portion;

a brush held within said brush holder and having a leading end portion extending forwardly beyond a leading end portion of said brush holder;

said shaft member being engageable with said open end of said container in a storage position whereat said brush is within said container and said leading end portion of said brush extends through said central hole in said wall of said valve disc member to contact liquid cosmetic in said storage chamber such that the cosmetic liquid is applied to and held by said brush and said leading end portion of said brush holder does not extend through said central hole;

said shaft member being disengageable from said open end of said container in a withdrawn position whereat said brush and cosmetic liquid held thereby are withdrawn from said container for application of the cosmetic liquid by said brush;

an annular projection extending forwardly from said front end portion of said shaft member, said annular projection surrounding a base portion of said brush holder and defining therebetween an annular recess, and at least one longitudinally extending groove formed in an outer surface of said brush holder and extending into said annular recess, said groove and said annular recess forming reservoirs for excess cosmetic liquid applied to said brush; and said annular projection having a forward end portion that engages said annular outer end of said valve disc member in a sealing manner when said shaft member is in said storage position thereof.

2. A cosmetic applicator as claimed in claim 1, wherein plural longitudinally extending grooves are formed in said outer surface of said brush holder.

3. A cosmetic applicator as claimed in claim 2, further comprising at least one through hole extending through said brush holder at a position adjacent said base portion thereof, said through hole opening into said annular recess.

4. A cosmetic applicator as claimed in claim 3, comprising plural, circumferentially spaced through holes extending through said brush holder and opening into said annular recess.

5. A cosmetic applicator as claimed in claim 1, further comprising at least one through hole extending through said brush holder at a position adjacent said base portion thereof, said through hole opening into said annular recess.

6. A cosmetic applicator as claimed in claim 1, wherein said brush holder has a configuration that diverges toward said annular projection, and said groove has a depth that increases gradually toward said annular projection.

7. A cosmetic applicator as claimed in claim 1, wherein said valve disc member comprises an elastic member, and said forward end portion of said annular projection is tapered.

8. A cosmetic applicator as claimed in claim 1, further comprising a rearwardly divergent cylindrical body positioned over said outer surface of said brush holder.

9. A cosmetic applicator as claimed in claim 1, wherein said brush holder has an inner surface the entirety of which is in contact with said brush.

* * * * *